US010557325B2

(12) United States Patent
Korf

(10) Patent No.: US 10,557,325 B2
(45) Date of Patent: Feb. 11, 2020

(54) CUTTING TOOL

(71) Applicant: Weatherford Technology Holdings, LLC, Houston, TX (US)

(72) Inventor: Joshua Matthew Korf, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 184 days.

(21) Appl. No.: 15/045,927

(22) Filed: Feb. 17, 2016

(65) Prior Publication Data

US 2016/0237770 A1 Aug. 18, 2016

Related U.S. Application Data

(60) Provisional application No. 62/117,870, filed on Feb. 18, 2015.

(51) Int. Cl.

| | |
|---|---|
| ***E21B 29/00*** | (2006.01) |
| ***E21B 7/06*** | (2006.01) |
| ***E21B 29/06*** | (2006.01) |
| ***E21B 10/42*** | (2006.01) |
| ***E21B 10/55*** | (2006.01) |

(52) U.S. Cl.

CPC ..... *E21B 29/002* (2013.01); *E21B 7/061* (2013.01); *E21B 10/42* (2013.01); *E21B 10/55* (2013.01); *E21B 29/06* (2013.01)

(58) Field of Classification Search

CPC .. E21B 7/061; E21B 29/06; E21B 10/26–345; E21B 10/42–43; E21B 7/06–068; E21B 10/52; E21B 10/54–58

See application file for complete search history.

(56) References Cited

U.S. PATENT DOCUMENTS

| | | | | |
|---|---|---|---|---|
| 2,058,327 | A * | 10/1936 | Lane | E21B 7/061 166/117.5 |
| 5,771,942 | A | 6/1998 | Bunger | |
| 5,771,972 | A | 6/1998 | Dewey et al. | |
| 5,887,668 | A * | 3/1999 | Haugen | E21B 7/061 175/79 |
| 5,979,571 | A | 11/1999 | Scott et al. | |
| 6,568,492 | B2 | 5/2003 | Thigpen et al. | |
| 6,612,383 | B2 | 9/2003 | Desai et al. | |

(Continued)

FOREIGN PATENT DOCUMENTS

| | | |
|---|---|---|
| EP | 0916803 A2 | 5/1999 |
| GB | 2420359 A | 5/2006 |

OTHER PUBLICATIONS

PCT International Search Report and Written Opinion dated Jun. 2, 2016, for International Application No. PCT/2016/018200.

(Continued)

*Primary Examiner* — George S Gray

(74) *Attorney, Agent, or Firm* — Patterson + Sheridan, LLP

(57) ABSTRACT

A method of cutting a casing and a formation includes providing a rotatable cutting tool in a wellbore, wherein the rotatable cutting tool includes a first portion configured for cutting the casing and a second portion configured for cutting the formation. The method further includes engaging the first portion with the casing in the wellbore; and engaging the second portion with the casing after engaging the first portion with the casing.

24 Claims, 5 Drawing Sheets

(56) References Cited

U.S. PATENT DOCUMENTS

| | | | | |
|---|---|---|---|---|
| 7,025,156 | B1 * | 4/2006 | Caraway | E21B 10/54 166/55.1 |
| 7,178,609 | B2 | 2/2007 | Hart et al. | |
| 7,624,818 | B2 | 12/2009 | McClain et al. | |
| 7,954,570 | B2 | 6/2011 | McClain et al. | |
| 2009/0133877 | A1 * | 5/2009 | Neff | E21B 7/061 166/298 |

OTHER PUBLICATIONS

Trahan et al., "One-trip casing exit milling saves time during complex drilling," Offshore Magazine, Apr. 9, 2014, vol. 74, Issue 4, pp. 82-85.
United Kingdom Office Action in related application GB1712981.8 dated Aug. 16, 2019.
United Kingdom Office Action in related application GB1712981.8 dated Aug. 30, 2017.
United Kingdom Office Action in related application GB1712981.8 dated Feb. 19, 2019.
International Preliminary Report on Patentability in related applicaiton PCT/US2016/018200 dated Aug. 31, 2017.

* cited by examiner

CUTTING TOOL

BACKGROUND OF THE INVENTION

Field of the Invention

Embodiments of the present invention relate generally to a casing exit tool. More specifically, the embodiments relate to a tool capable of milling a casing and drilling a formation in a single trip.

Description of the Related Art

In well construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a string of casing is lowered into the wellbore. An annulus is thus formed between the string of casing and the formation. A cementing operation is then conducted in order to fill the annulus with cement. The casing string is cemented into the wellbore by circulating cement into the annulus. The combination of cement and casing strengthens the wellbore and facilitates the isolation of certain areas of the formation behind the casing for the production of hydrocarbons.

In some production operations, it may be desirable to form a lateral wellbore, or sidetrack wellbore, relative to the cased wellbore in order to enhance the efficiency of production. Sidetrack drilling is a process which allows an operator to drill a primary wellbore, and then drill an angled lateral wellbore off of the primary wellbore at a chosen depth. Generally, the primary wellbore is first cased with the string of casing and cemented. Then, a tool known as a whipstock is positioned in the casing at the depth where deflection is desired. The whipstock is specially configured to divert a casing exit tool in a desired direction in order to mill a window in the casing and drill a lateral wellbore in the formation.

Generally, cutting structures suitable for drilling rock formations are not suitable for milling steel casing, and vice versa. For example, cutting structures suitable for milling steel casing, such as carbide, are durable and may significantly deform while drilling rock formations. As such, carbide may not effectively drill rock formations. Conversely, cutting structures suitable for drilling rock formations, such as polycrystalline diamond compact (PDC), are brittle and may chip while milling steel casing. As such, PDC may not effectively mill steel casing. Accordingly, current casing exit tools having materials for both drilling rock formations and milling steel casing are susceptible to jamming in the casing. Conventionally, this challenge is overcome by making multiple trips into the wellbore. For example, a window mill, equipped with materials suitable for cutting steel, is lowered into the primary wellbore solely to form the window in the casing. Then, the window mill is removed from the primary wellbore and replaced by a drill bit equipped with materials suitable for drilling the rock formation. The drill bit passes through the window formed by the window mill and drills the lateral wellbore. However, making multiple trips into the wellbore is expensive and time-consuming.

Thus, there is a need for a casing exit tool that can cut the casing and the formation in a single trip.

SUMMARY OF THE INVENTION

In one embodiment, a method of cutting a casing and a formation includes providing a rotatable cutting tool in a wellbore, wherein the rotatable cutting tool includes a first portion configured for cutting the casing and a second portion configured for cutting the formation; engaging the first portion with the casing in the wellbore; and engaging the second portion with the casing after engaging the first portion with the casing.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a longitudinal axis of a wellbore, and "below", "lower", "downward" and similar terms refer to a direction away from the earth's surface along the longitudinal axis of the wellbore.

The present invention is a method and apparatus for cutting a casing and a formation in a single trip.

Figure 1:
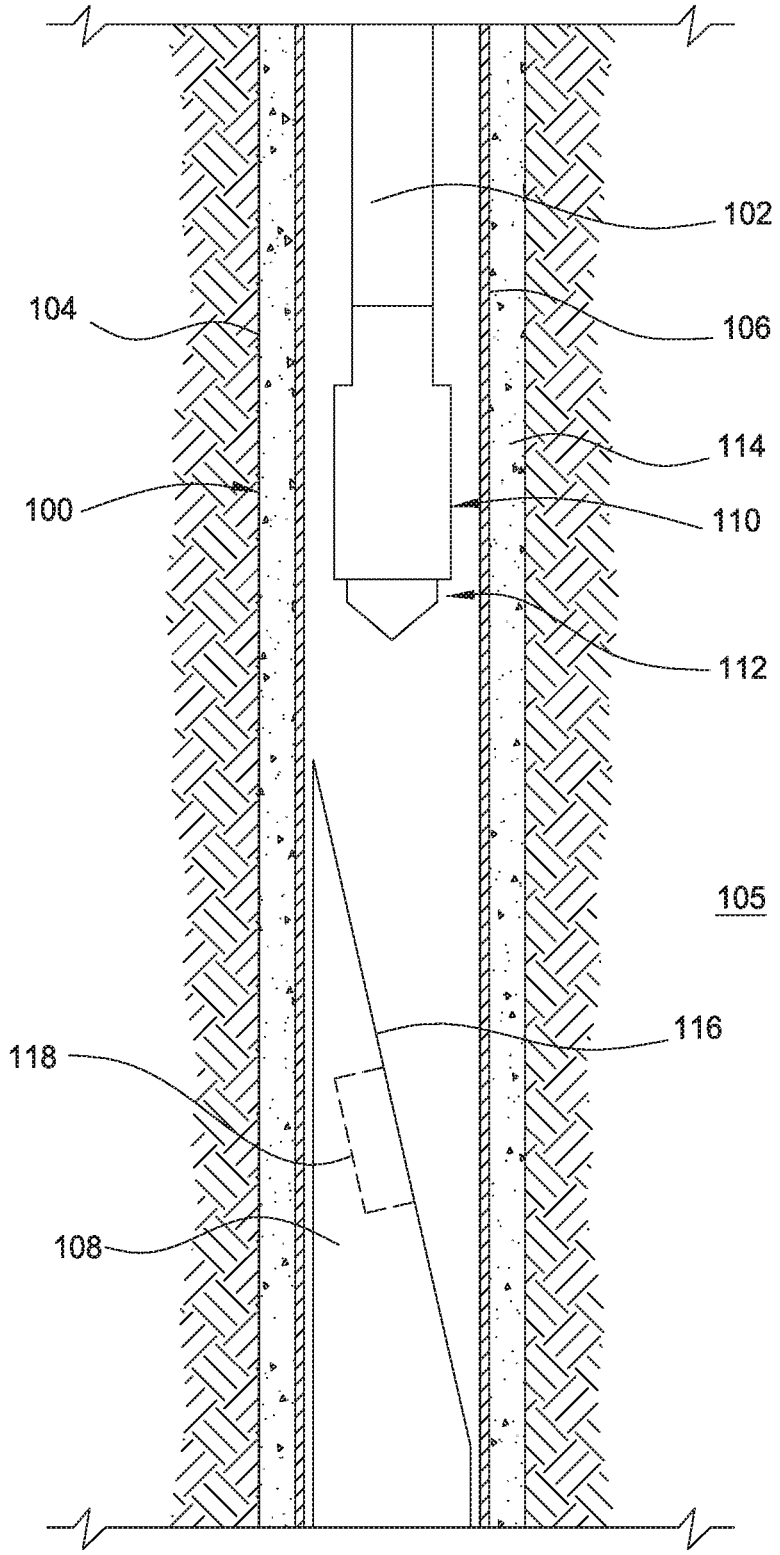
FIG. 1 illustrates a tool connected with a drill string in a wellbore, according to one embodiment of the present invention.

FIG. 1 shows a tool 100 connected with a drill string 102, according to one embodiment of the present invention, configured to implement one or more aspects of the present invention. As shown, a wellbore 104 is formed in a formation 105, and includes the tool 100, the drill string 102, and a whipstock 108 disposed in a casing 106. The tool 100 includes a first portion, such as a milling portion 110, preferentially configured for cutting non-rock material, such as metal. The tool 100 also includes a second portion, such as a drilling portion 112, preferentially configured for cutting rock material. During operation, drilling portion 112 is lower than milling portion 110, or said otherwise, drilling portion 112 is "forward" of milling portion 110. Consequently, drilling portion 112 may be referred to as the "pilot portion" of tool 100.

As shown, the wellbore 104 is lined with casing 106 to a predetermined depth. Although the wellbore 104 is shown extending vertically in the formation 105, the wellbore 104 may be drilled in any orientation without departing from the spirit and scope of the invention. The casing 106 in the wellbore 104 may include a metal, such as steel. The casing 106 is supported by cement 114 injected in an annulus between the casing 106 and the formation 105. The tool 100 is located at a distal end of the drill string 102. The whipstock 108 is located below both the tool 100 and the drill string 102 for forming a lateral wellbore 302 (FIG. 3D). The whipstock 108 includes a tapered portion having a guiding surface 116 for moving the tool 100 in a lateral direction relative to the wellbore 104 when the tool 100 moves downwards along the whipstock 108. In one embodiment, the tapered portion of the whipstock 108 has an angle ranging from 1 degree to 5 degrees relative to a longitudinal axis of the wellbore 104. In another embodiment, the tapered portion of the whipstock 108 has an angle ranging from 1 degree to 4 degrees relative to a longitudinal axis of the wellbore 104. The guiding surface 116 may be configured to prevent the tool 100 from cutting through the whipstock 108 as the tool 100 moves downwards in the casing 106. The guiding surface 116 may also be configured to prevent the tool 100 from cutting through a retrieval slot 118 in the whipstock 108 as the tool 100 moves downwards in the casing 106. For example, the guiding surface 116 may be smooth such that friction between the tool 100 and the whipstock 108 is minimized. The whipstock 108 may laterally move the tool 100 into contact with the casing 106 to cut the casing 106 and to the formation 105 in a single trip. In other words, the tool 100 is not removed from the casing 106 between cutting the casing 106 and cutting the formation 105.

Figure 2A:
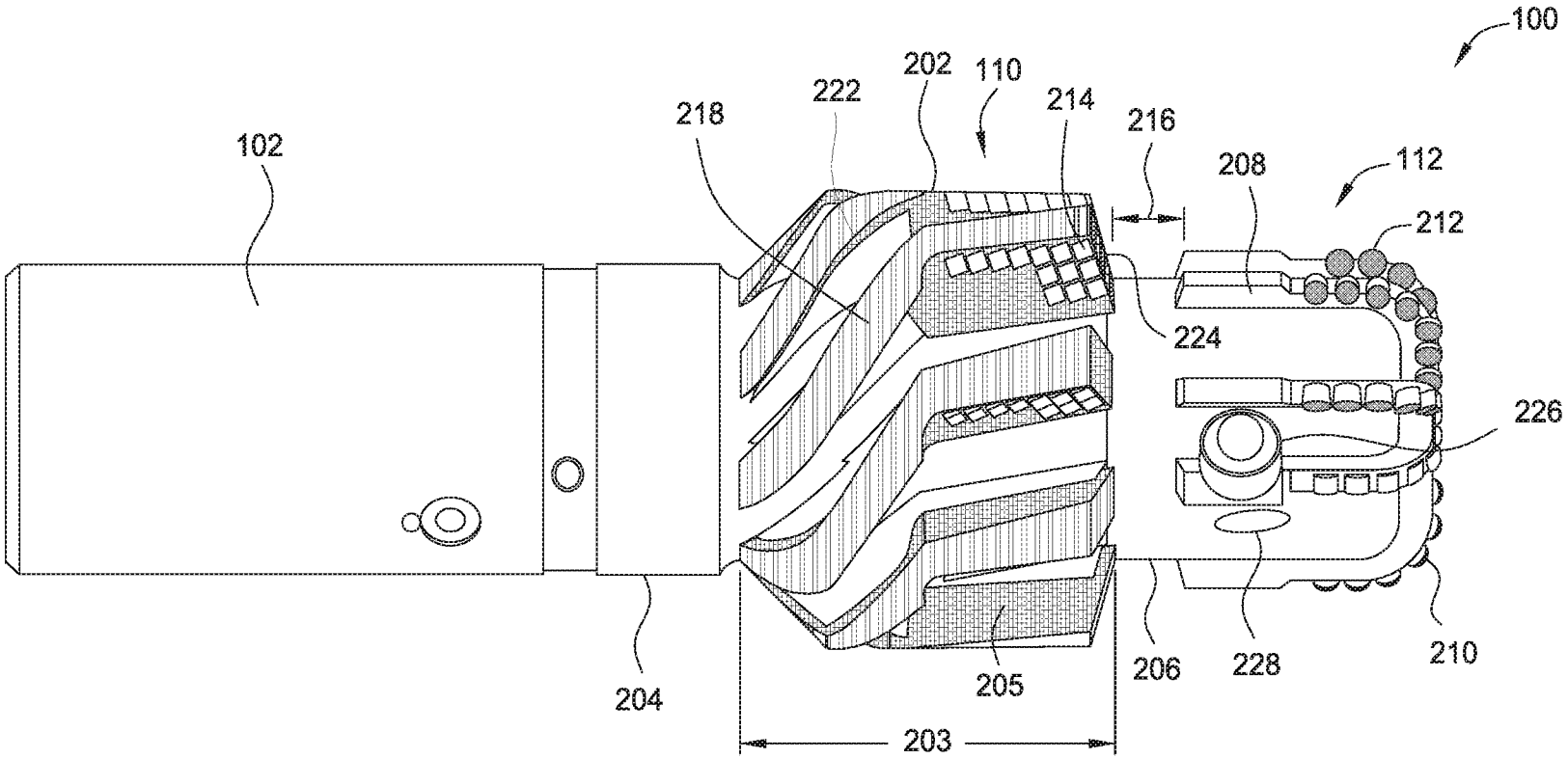
FIG. 2A shows a side view of the tool.
Figure 2B:
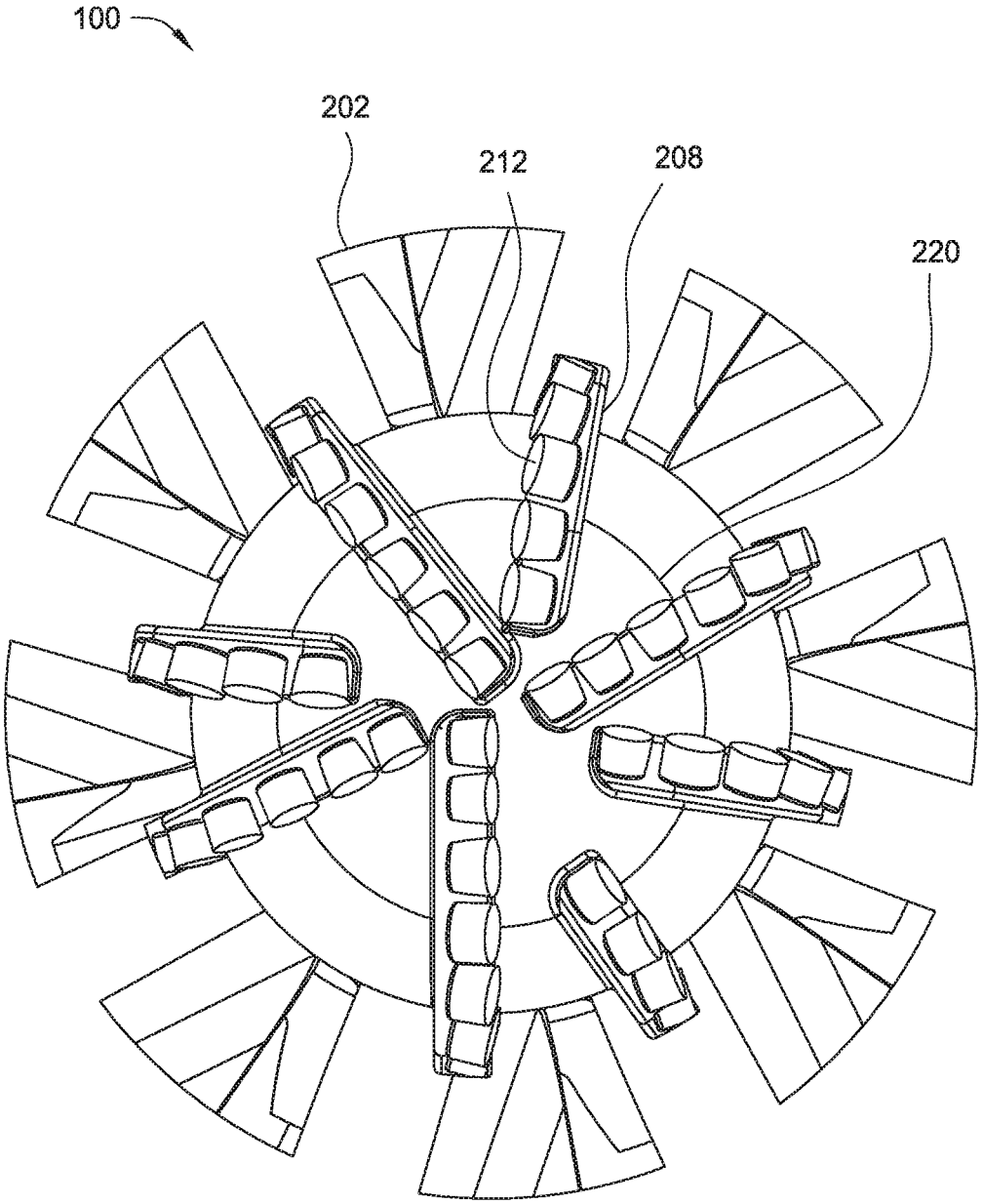
FIG. 2B shows a bottom-up view of the tool.

FIGS. 2A and 2B show an exemplary embodiment of the tool 100 of FIG. 1. FIG. 2A shows the milling portion 110 connected with the drilling portion 112 of the tool 100. FIG. 2B shows a bottom 220 of a drilling body 206 of the tool 100.

Referring specifically to FIG. 2A, the milling portion 110 may include a milling body 204 and a plurality of milling blades 202 disposed thereon. The drilling portion 112 may include the drilling body 206 and a plurality of drilling blades 208 disposed thereon. The plurality of milling blades 202 on the milling body 204 are configured to mill a window 300 (FIG. 3D) in the casing 106.

The tool 100 may comprise any appropriate number of milling blades 202. The number of milling blades 202 used in a single-trip cutting operation may range from 5 to 25. In one example, the number of milling blades 202 ranges from 5 to 20. In another example, the number of milling blades 202 ranges from 6 to 15. As shown in FIGS. 2A and 2B, eight milling blades 202 are used. The number of milling blades 202 used in the operation and a thickness of each milling blade 202 may be selected based upon a drift diameter of the casing 106, a cutting pressure used to cut the casing 106, and/or a load on the tool 100. For example, the cutting pressure and/or the load exerted on the tool 100 during milling may be sufficiently high such that a larger number of milling blades 202 are used to prevent the tool 100 from jamming in the casing 106. In one embodiment, 2 to 4 milling blades 202 are added to the tool 100 for every 10% to 30% increase in maximum anticipated cutting pressure and/or load exerted on the tool 100.

Each milling blade 202 may comprise any appropriate length. Each milling blade 202 may have a length 203 ranging from 3 inches to 17 inches. In one example, each milling blade 202 has a length 203 ranging from 4 inches to 14 inches. In another example, each milling blade 202 has a length 203 ranging from 5 inches to 12 inches. In yet another example, each milling blade 202 has a length 203 ranging from 5 inches to 8 inches. The length 203 of each milling blade 202 corresponds to the size of the casing. For example, the length 203 is selected such that the milling blades 202 provide stability to the tool 100. In another example, the length 203 is selected to provide a normal lateral force against the casing 106 such that the tool 100 cuts out of the casing 106 when the tool 100 slides on the tapered portion of the whipstock 108.

Each milling blade 202 may have a height measured radially from an outer surface of the milling body 204 to an outermost edge of the milling blade 202. For example, the height of each milling blade 202 may range from 0.1 inches to 4 inches. In another example, the height of each milling blade 202 may range from 0.25 inches to 3 inches. In yet another example, the height of each milling blade 202 may range from 1 inch to 2 inches. The height of each milling blade 202 is such that the milling portion 110 provides the window 300 of sufficient size in order to subsequently run in other tools through the window 300 and the lateral wellbore 302. For example, the window 300 should have an opening at least as large as an opening formed by the drift diameter of the casing 106. In one embodiment, the drift diameter of the casing 106 ranges from 3 inches to 18 inches. A diameter of each portion 110, 112 may be calculated by measuring and doubling a sweep of each portion 110, 112. For example, the sweep of each portion 110, 112 may be measured from a rotational axis of the tool 100 to an outermost edge of the respective blades 202, 208. The milling portion 110 may have a diameter equal to or slightly greater than the drift diameter of the casing 106. In one embodiment, the milling portion 110 may have a diameter 0.01 inches to 0.03 inches greater than the drift diameter of the casing 106. As shown in FIGS. 2A and 2B, the drilling portion 112 may have a diameter less than the diameter of the milling portion 110. Consequently, the milling portion 110 or milling blades 202 may be referred to as "full gauge" or "outer diameter". In one embodiment, the drilling portion 112 has a diameter ranging from 2 inches to 15 inches. In another embodiment, the drilling portion 112 has a diameter ranging from 3 inches to 14 inches. The diameter of the drilling portion 112 may be determined by the geometry between the inner and outer diameters of the casing 106 and a concave angle formed by the whipstock 108 and the casing 106.

The milling blades 202 may be formed on raised portions of the milling body 204. For example, the milling body 204 may have a raised portion, such as a milling blade frame 222, on which each milling blade 202 is formed. As such, the height of each milling blade 202 may include a height of the raised portion. As shown in FIG. 2A, each milling blade 202 may be parallel or substantially parallel with a longitudinal axis of the milling body 204 along a first length of the milling body 204. In one example, substantially parallel includes a deflection ranging from 0 degrees to 15 degrees relative to the longitudinal axis of the milling body 204. In another example, substantially parallel includes a deflection ranging from 0 degrees to 10 degrees relative to the longitudinal axis of the milling body 204. Each milling blade 202 may deflect to form at least a partial helix around the milling body 204 along a second length of the milling body 204. Each milling blade 202 may also be tapered along the second length of the milling body 204. The milling body 204 may be configured to threadedly connect to the drill string 102 and the drilling body 206.

Each milling blade 202 may include a durable material 205 suitable for cutting the casing 106. For example, the durable material 205 may include exposed carbide and/or tungsten carbide, such as carbide inserts 214. The durable material 205 may also include a crushed carbide in a braze matrix 218 disposed around the carbide inserts 214. The carbide inserts 214 and the crushed carbide in the braze matrix 218 may be brazed onto the milling blade frame 222 and milling body 204 by a copper nickel alloy. For example, the copper nickel alloy may selectively hold the carbide inserts 214 in a position to engage the casing 106 during the operation. The carbide inserts 214 and the crushed carbide in the braze matrix 218 may also be brazed onto the milling blade frame 222 and milling body 204 by any other suitable material, as is known in the art. As shown in FIG. 2A, the carbide inserts 214 may be disposed on a side of the milling blades 202 facing the direction of rotation of the tool 100. The carbide inserts 214 may also be disposed at or near a leading edge 224 of each milling blade 202, as shown in FIG. 2A. In one example, the term "near" includes a space formed by 50% of the length 203 nearest the leading edge 224. In another example, the term "near" includes a space formed by 25% of the length 203 nearest the leading edge 224. In one embodiment, the carbide inserts 214 may be supported by the crushed carbide in the braze matrix 218 at a corner of the milling blades 202 extending along the first length of the milling body 204. In another embodiment, the carbide inserts 214 may be disposed all along the length 203 of the milling blades 202. For example, the carbide inserts 214 may be brazed onto the milling blade frame 222 which may extend the length 203. The crushed carbide in the braze matrix 218 may be disposed on the milling blade frame 222 to support the carbide inserts 214. As the tool 100 rotates to cut the casing 106, the carbide inserts 214 may make direct contact with the steel casing 106. As such, the carbide inserts 214 in the durable material 205 engage the casing 106.

Between the milling blades 202 and the drilling blades 208 is an axial clearance 216. The axial clearance 216 may be provided to prevent the tool 100 from jamming in the casing 106 by ensuring that the milling blades 202 contact the casing 106 before the drilling blades 208 contact the casing 106. For example, a larger axial clearance 216 is provided when the tool 100 operates in a larger diameter casing 106. Thereafter, the axial clearance 216 may provide for an arrangement wherein the milling blades 202 and the drilling blades 208 simultaneously cut the casing 106. In one embodiment, the axial clearance 216 may have a length ranging from 1 inch to 8 inches. In another embodiment, the axial clearance 216 may have a length ranging from 3 to 5 inches.

The drilling portion 112 may include the plurality of drilling blades 208 disposed on the drilling body 206. The drilling body 206 may have a diameter equal or substantially equal to the diameter of the milling body 204. In one example, a difference between the diameter of the drilling body 206 and the diameter of the milling body 204 may range from 0% to 10%. In another example, a difference between the diameter of the drilling body 206 and the diameter of the milling body 204 may range from 0% and 5%. The drilling body 206 may be configured to threadedly connect to the milling body 204 and/or the drill string 102. The drilling blades 208 are configured to cut the casing 106 (FIG. 3B) simultaneously with the milling blades 202. The drilling blades 208 are also configured to cut the formation 105.

The tool 100 may comprise any appropriate number of drilling blades 208. In one embodiment, the number of drilling blades 208 used in the single-trip cutting operation may range from 3 to 16. In another embodiment, the number of drilling blades 208 may range from 3 to 12. In yet another embodiment, the number of drilling blades 208 may range from 4 to 10. As shown in FIG. 2B, the number of drilling blades 208 used is eight.

In one embodiment, a single trip into the wellbore 104 may include using the tool 100 to run and set the whipstock 108 into the casing 106 in addition to using the tool 100 to cut the casing 106 and the formation 105. In other words, the tool 100 is not removed from the casing 106 between setting the whipstock 108 and at least one of cutting the casing 106 and cutting the formation 105. As shown in FIG. 2A, the tool 100 includes an opening 226 for receiving a shear bolt. In one embodiment, the opening 226 is disposed in the drilling portion 112. A first end of the shear bolt may be threaded into the opening 226 and a second end of the shear bolt may be coupled to the whipstock 108. In operation, the tool 100 may be run into the wellbore 104 with the whipstock 108 operatively coupled to the drilling portion 112 via the shear bolt. Next, the whipstock 108 may be anchored in the casing 106 and the shear bolt sheared by an upward, downward, and/or rotational force on the drill string 102. With the whipstock 108 anchored in the casing 106 and detached from the tool 100, the tool 100 may be subsequently operated as described herein to cut the casing 106 and the formation 105. In another embodiment, the milling portion 110 may include an opening similar to opening 226. Thus, in operation, the whipstock 108 may be run and set in the casing 106 by operatively coupling the whipstock 108 to the milling portion 110 via the shear bolt. In yet another embodiment, the axial clearance 216 may include an opening similar to opening 226. Thus, in operation, the whipstock 108 may be run and set in the casing 106 by operatively coupling the whipstock 108 to the axial clearance 216 via the shear bolt.

As shown in FIG. 2A, the tool 100 includes an opening 228. In one embodiment, fluid is pumped out of the opening 228 and into the wellbore 104 to move cutting debris away from the tool 100 during the operation. For example, suitable pressurized milling or drilling fluid is communicated through the drill string 102 and exits the tool 100 at the opening 228. The water may clear away cutting debris below the tool 100 and move the cutting debris upwards in the casing 106. For example, the cutting debris may move upwards between the drill string 102 and the casing 106.

Referring now to FIGS. 2A and 2B, each drilling blade 208 may extend along a side of the drilling body 206 and the bottom 220 of the drilling body 206. For example, as shown in FIG. 2B, each drilling blade 208 may generally extend radially from a center of the bottom 220 of the drilling body 206 and, as shown in FIG. 2A, extend axially along the side of the drilling body 206. Each drilling blade 208 may include a hard material 210 suitable for cutting the formation 105. For example, the hard material 210 may include exposed polycrystalline diamond compact (PDC) inserts 212. In one embodiment, the hard material 210 is more brittle than the durable material 205. In another embodiment, the durable material 205 is more deformable than the hard material 210. The exposed PDC inserts 212 may be brazed onto the drilling blades 208 using any suitable material, as is known in the art. In one embodiment, the exposed PDC inserts 212 are be brazed onto the drilling blades 208 using a copper nickel alloy. The copper nickel alloy may selectively hold the exposed PDC inserts 212 in an exposed position to directly contact the steel casing 106 and the formation 105. As such, the exposed PDC inserts 212 in the hard material 210 engage the casing 106. In one embodiment, the axial clearance 216 is defined between the carbide inserts 214 and the PDC inserts 212. As shown in FIGS. 2A and 2B, the exposed PDC inserts 212 may be disposed on a side of the drilling blades 208 facing the direction of rotation of the tool 100. For example, the tool 100 in FIGS. 2A and 2B may rotate in the clockwise direction from a perspective of a user at a surface of the wellbore 104. As such, the exposed PDC inserts 212 in FIGS. 2A and 2B face the clockwise direction from the perspective of the user at the surface of the wellbore 104 to perform the single-trip cutting operation. The exposed PDC inserts 212 may also be disposed at a leading edge of each drilling blade 208 such that the exposed PDC inserts 212 direct contact the casing 106 and the formation 105. The exposed PDC inserts 212 may be initially used to engage and cut the casing 106, and subsequently used to engage and cut the formation 105.

Figure 3B:
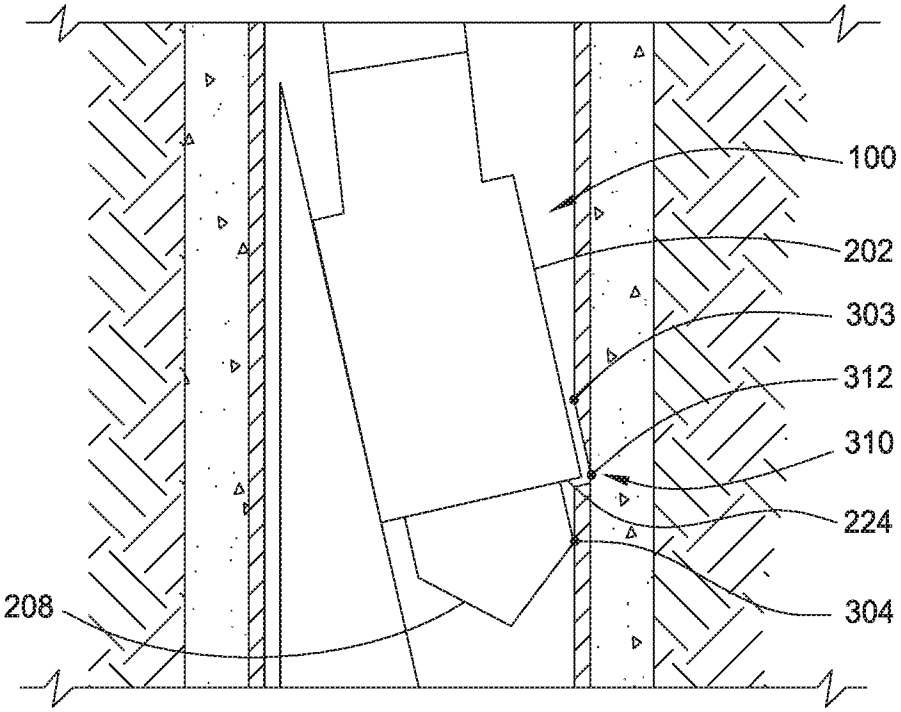
FIG. 3B shows the plurality of milling blades and a plurality of drilling blades of the tool both engaging the casing.
Figure 3A:
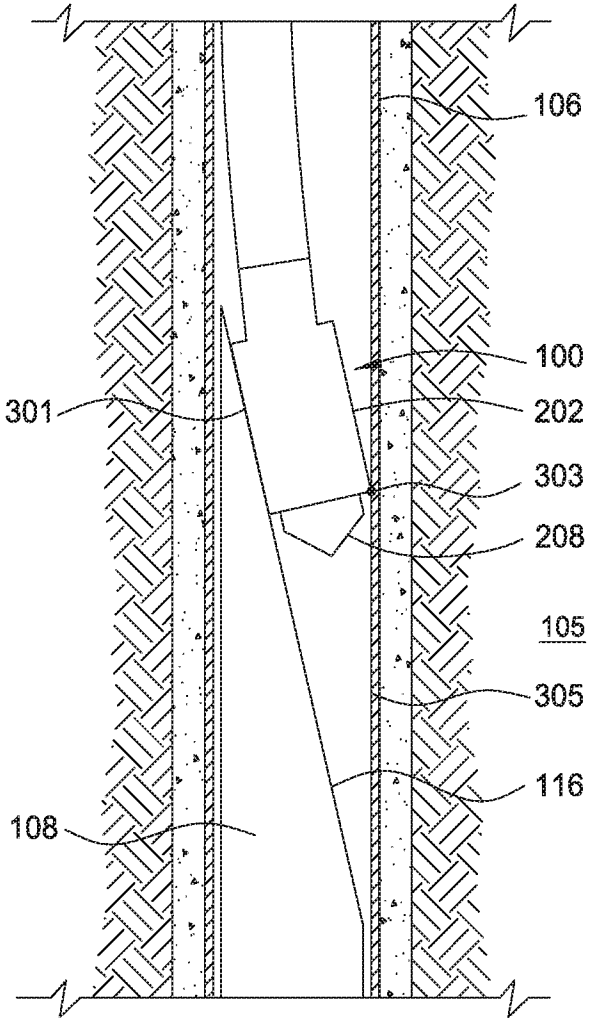
FIG. 3A shows a plurality of milling blades on the tool engaging a casing.
Figure 3D:
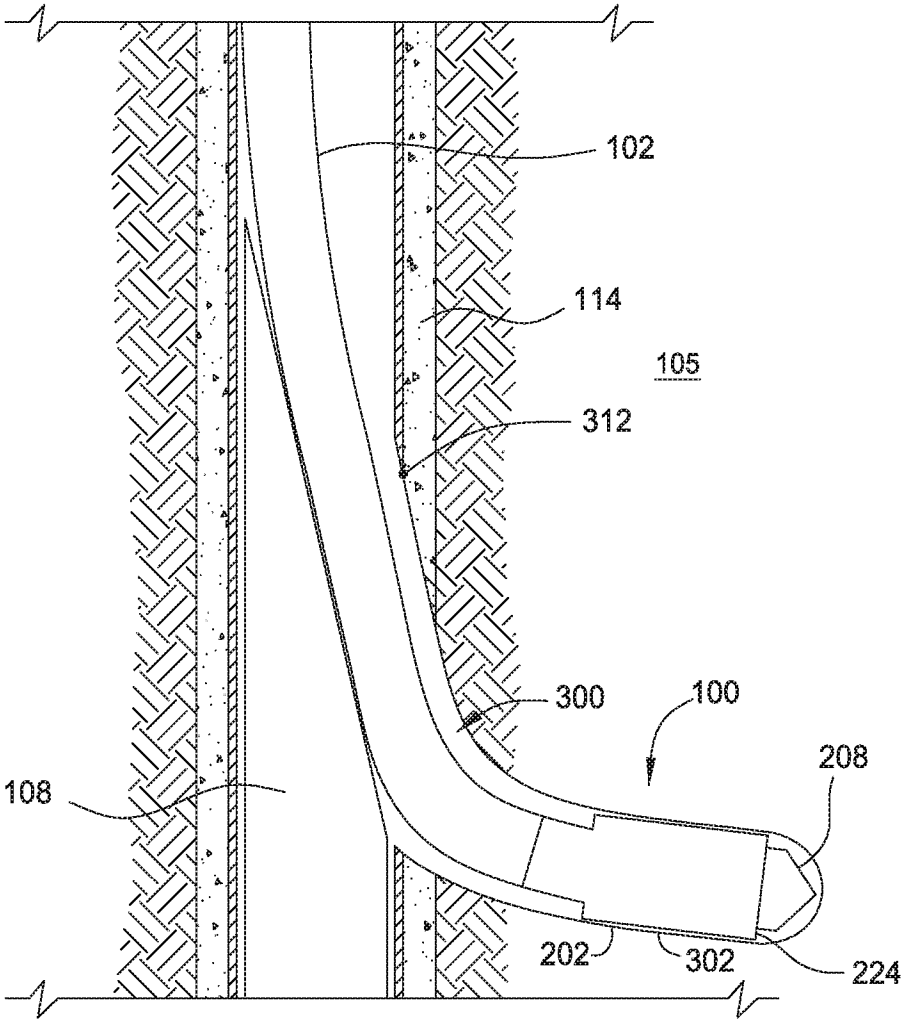
FIG. 3D shows the tool in a lateral wellbore and the drill string extending through a window.
Figure 3C:
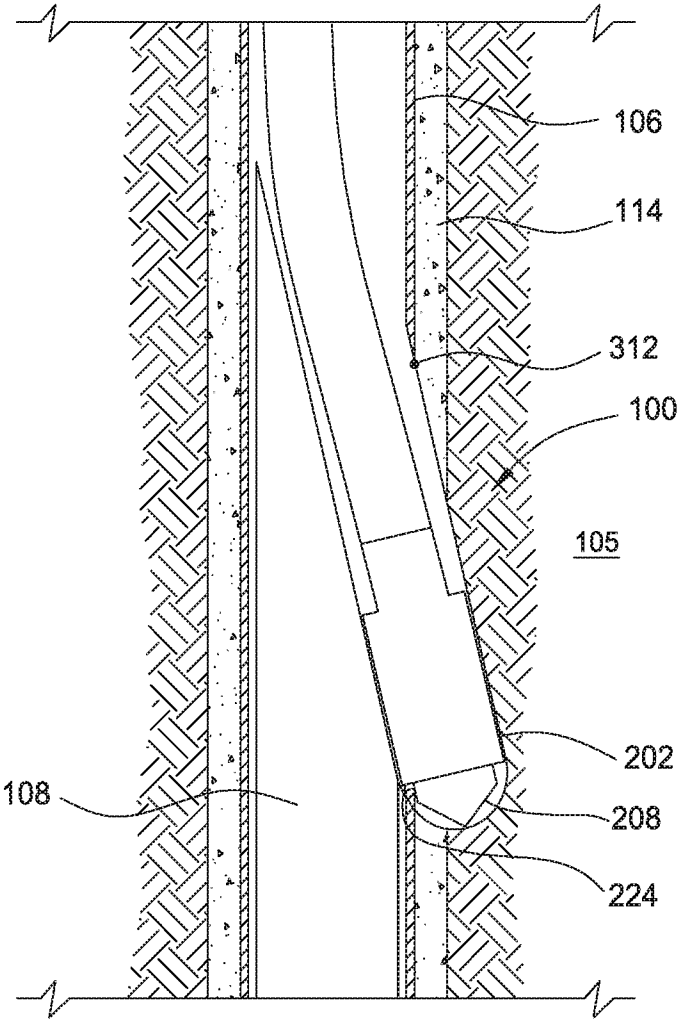
FIG. 3C shows both the plurality of milling blades and the plurality of drilling blades cutting a formation.

FIGS. 3A-3D illustrate the operation of the tool 100 as it cuts the casing 106 and cuts the formation 105 in a single trip. FIG. 3A shows the milling blades 202 engaging both the guiding surface 116 of the whipstock 108 and a milling contact point 303 on an inner surface 305 the casing 106. FIG. 3B shows the milling blades 202 and the drilling blades 208 both engaging the casing 106. FIG. 3C shows both the milling blades 202 and the drilling blades 208 cutting the formation 105. FIG. 3D shows the tool 100 in the lateral wellbore 302 and the drill string 102 extending through the window 300. Although the operation of the tool 100 is described in relation to a single layer of casing 106, the tool 100 may be configured to cut multiple layers of casing without departing from the spirit and scope of the disclosure.

As shown in FIG. 3A, the drilling blades 208 having the hard material 210 are held in a position away from the casing 106 and the whipstock 108. For example, the exposed PDC inserts 212 are initially positioned such that the exposed PDC inserts 212 do not engage either the casing 106 or the whipstock 108. It is possible that the drilling blades 208 do not engage the whipstock 108 throughout the operation. In operation, the tool 100 is rotated and lowered in the wellbore 104 such that the milling blades 202 contact the guiding surface 116 of the whipstock 108 at an initial whipstock contact point 301. The initial whipstock contact point 301 is located towards an upper end of the whipstock 108. The location of the initial whipstock contact point 301 may vary between operations. In some embodiments, drilling blades 208 may briefly contact the guiding surface 116 of the whipstock 108 prior to milling blades 202 making contact at initial contact point 301. When the milling blades 202 engage the initial whipstock contact point 301, the drilling blades 208 are held in a position away from the whipstock 108 and the casing 106. For example, due to the configuration of the axial clearance 216 and the relative diameters of the milling blades 202 and the drilling blades 208, the exposed PDC inserts 212 do not engage either the whipstock 108 or the casing 106 when the tool 100 is in the position shown in FIG. 3A. After the milling blades 202 engage the initial whipstock contact point 301, weight may be exerted on the drill string 102 to move the rotating tool 100 further downhole. As the tool 100 moves downhole, the milling blades 202 slide on the tapered portion of the whipstock 108. In one embodiment, the milling blades 202 may partially cut a layer of the guiding surface 116. The tapered portion of the whipstock 108 moves the tool 100 in the lateral direction relative to the wellbore 104. The milling blades 202 advance along the guiding surface 116 until the milling blades 202 engage the casing 106 at the milling contact point 303.

The carbide inserts 214 will begin cutting the casing 106 after the milling blades 202 engage the casing 106 at the milling contact point 303. Between the time the milling blades 202 engage the initial whipstock contact point 301 and the time the milling blades 202 engage the milling contact point 303, the drilling blades 208 generally remain positioned away from both the whipstock 108 and the casing 106. As the milling blades 202 begin cutting the casing 106, the drilling blades 208 continue to generally remain positioned away from both the whipstock 108 and the casing 106.

During cutting the casing, the tool 100 may jump and skip in the casing 106. The jumping and skipping of the tool 100 may be attributed to contact voids between the tool 100, the casing 106, and the whipstock 108 which prevent stable cutting conditions. For example, as the milling blades 202 rotate to cut the casing 106 at the milling contact point 303, the tool 100 may experience an interruption in cutting such that all of the milling blades 202 on the tool 100 contemporaneously disengage from the casing 106 and/or the whipstock 108. This phenomenon is referred to as a jump. The tool 100 may continue to rotate during the jump, and at least one milling blade 202 may rotate past the casing 106 without contacting the casing 106. This phenomenon is referred to as a skip. The tool 100 may experience subsequent jumps when at least one of the milling blades 202 bump the casing 106 and/or the whipstock 108. As used herein, the term "bump" includes reengaging the casing 106 and/or the whipstock 108 with such intensity that either the hard material 210 or the durable material 205 deforms or chips. The erratic nature of the tool 100 as the tool 100 jumps, skips, and bumps is indicative of an unstable cutting condition. Jumps, skips, and bumps may be detected by various mechanisms along the drill string or at the surface, including spikes and other irregularities in torque readings. Tool 100 or portions thereof may "engage" with whipstock 108, casing 106, or formation 105 under either stable or unstable cutting conditions. In other words, the occurrence of jumps, skips, or bumps is not determinative of engagement/disengagement.

During the unstable cutting condition, the exposed PDC inserts 212 may remain positioned away from both the casing 106 and the whipstock 108, although, the unstable cutting condition may temporarily cause the PDC inserts 212 to contact either the casing 106 or the whipstock 108, or both. Weight may be added to the drill string 102 to urge the tool 100 into a stable cutting condition. Unstable cutting conditions may be more likely when milling portion 110 begins cutting the casing 106 at the milling contact point 303. Stable cutting conditions may be more likely after milling portion 110 has cut a sufficient portion of casing 106 (i.e., cut to a sufficient depth) to allow more than one milling blade 202 to be in simultaneous contact with casing 106. When milling portion 110 has more milling blades 202, stable conditions are more likely at a shallower depth of cut than when milling portion 110 has fewer milling blades 202. When milling portion 110 has a larger sweep, stable conditions are more likely at a shallower depth of cut than when milling portion 110 has a smaller sweep.

In one embodiment, the stable cutting condition (i.e., absence of jumps, skips, and bumps) may be experienced when the milling portion 110 experiences uninterrupted cutting. The milling portion 110 may experience uninterrupted cutting when the milling blades 202 of the tool 100 have sufficiently cut into the casing 106 such that, throughout each rotation of tool 100, at least one of the milling blades 202 engages the casing 106 at all times.

In one example, the tool 100 experiences uninterrupted cutting when the milling blades 202 cut entirely through the casing 106. For example, uninterrupted cutting may be experienced when the carbide inserts 214 on the milling blades 202 reach a casing exit point 312 on an outer surface of the casing 106. The casing exit point 312 may be below the milling contact point 303 relative to the casing 106. When the milling blades 202 reach the casing exit point 312, the milling blades 202 form a perforation 310 in the casing 106. The perforation 310 is distinct from the window 300 formed after the tool 100 has completed cutting the casing 106. The window 300 may refer to a resultant opening caused by the cutting combination of the milling blades 202 and the drilling blades 208, whereas the perforation 310 may refer to an initial opening in the casing 106 formed by the milling blades 202 alone. The perforation 310 may have any size capable of creation by the milling blades 202. In one example, the perforation 310 may be an initial puncture made by the carbide inserts 214 on the milling blades 202 at the casing exit point 312. In another example, the perforation 310 may be larger than the initial puncture such that the leading edge 224 of the milling blades 202 passes the casing exit point 312. After the milling blades 202 reach the casing exit point 312, the drilling blades 202 may engage the casing 106. FIG. 3B shows the tool 100 after experiencing uninterrupted cutting. As shown in FIG. 3B, the milling blades 202 have milled through the casing 106, and the drilling blades 208 have engaged the casing 106 at a drilling contact point 304 on the inner surface 305 of the casing 106.

In another example, uninterrupted cutting may be experienced after the leading edge 224 of the milling blades 202 pass the casing exit point 312. For example, at times the tool 100 may jump and skip in the casing 106 even after the milling blades 202 reach the casing exit point 312 and form the perforation 310. In one embodiment, the tool 100 may be urged further into the wellbore 104 such that the leading edge 224 of the milling blades 202 passes the casing exit point 312. Thereafter, throughout each rotation of tool 100, at least one of the milling blades 202 may engage the casing 106 at all times. As such, the milling blades 202 experience uninterrupted cutting after forming the perforation 310.

In yet another example, uninterrupted cutting may be experienced before the milling blades 202 cut through the entire the casing 106. For example, the milling blades 202 may engage the casing 106 and, before reaching the casing exit point 312, cut into the casing 106 such that, throughout each rotation of tool 100, at least one of the milling blades 202 engages the casing 106 at all times. Thus, uninterrupted cutting may be experienced before the milling blades 202 reach the casing exit point 312.

After the milling blades 202 experience uninterrupted cutting, the tool 100 may be moved by the whipstock 108 such that the drilling blades 208 engage the inner surface 305 of the casing 106. For example, after the tool 100 experiences uninterrupted cutting, the tool 100 may move further downhole such that the exposed PDC inserts 212 on the drilling blades 208 directly engage the casing 106 at the drilling contact point 304. In one embodiment, the drilling blades 208 may remain engaged with the casing 106 while the milling blades 202 remain engaged with the casing 106. Thus, the PDC inserts 212 and the carbide inserts 214 may both engage the casing 106 to form the window 300. By delaying the engagement of the exposed PDC inserts 212 with the casing 106 until after the tool 100 experiences uninterrupted cutting, the exposed PDC inserts 212 are prevented from failing or causing the tool 100 to jam in the casing 106. The drilling contact point 304 may be at a lower position on the inner surface 305 of the casing 106 relative to the milling contact point 303. The position of the drilling contact point 304 on the inner surface 305 of the casing 106, and thus, the distance between the milling contact point 303 and the drilling contact point 304, must be carefully configured to prevent blade failure or jamming as a result of the exposed PDC inserts 212 cutting the casing 106. For example, the axial clearance 216 and the relative diameters of the milling blades 202 and the drilling blades 208 may ensure a proper distance between the milling contact point 303 and the drilling contact point 304. The axial clearance 216 between the milling blades 202 and the drilling blades 208 may also be configured such that the exposed PDC inserts 212 do not engage the casing 106 before the tool 100 experiences uninterrupted cutting. Engaging the exposed PDC inserts 212 with the casing 106 before the tool 100 experiences uninterrupted cutting may cause the exposed PDC inserts 212 to fail and/or cause the tool 100 to jam. Conversely, the axial clearance 216 may be configured such that the carbide inserts 214 do not engage the formation 105 before the exposed PDC inserts 212 begin cutting the formation 105. The relative dimensions of the milling blades 202 and the drilling blades 208 are also configured to prevent blade failure and/or jamming.

As shown in FIG. 3B, a portion of the casing 106 between the casing exit point 312 and the drilling contact point 304 may remain unmilled when the exposed PDC inserts 212 engage the casing 106 at the drilling contact point 304. Thus, the milling blades 202 may continue to mill any unmilled casing 106 ahead of the leading edge 224 of the milling blades 202. As the rotating tool 100 moves downwards in the casing 106 and laterally relative to the wellbore 104 along the tapered portion of the whipstock 108, the carbide inserts 214 and the exposed PDC inserts 212 jointly engage the casing 106. As shown in FIG. 3B, the milling blades 202 remain engaged with the casing 106 when the drilling blades 208 engage the casing 106 at the drilling contact point 304. The tool 100 may continue to rotate such that the carbide inserts 214 cut the casing 106 at the same time that the exposed PDC inserts 212 cut the casing 106. The tool 100 may be urged downwards to advance the single-trip cutting operation.

Reference is now made specifically to FIG. 3C. FIG. 3C shows both the drilling blades 208 and the milling blades 202 cutting the formation 105. FIG. 3C also shows the milling blades 202 cutting the casing 106.

After the drilling blades 208 have cut through the casing 106, the drilling blades 208 cut through cement 114 and may begin cutting the lateral wellbore 302 in the formation 105. Thus, in one embodiment, the drilling blades 208 are configured to perform at least two functions: first, the drilling blades 208 cut the casing 106 to form the window 300; and second, the drilling blades 208 cut into the formation 105 to form the lateral wellbore 302. For example, the same exposed PDC inserts 212 that cut the casing 106 will cut the lateral wellbore 302. By delaying the engagement of the exposed PDC inserts 212 with the casing 106 until after uninterrupted cutting begins, and by cutting the casing 106 with both the exposed PDC inserts 212 and the carbide inserts 214, the exposed PDC inserts 212 avoid exhaustion and failure. For example, the exposed PDC inserts 212 avoid exhaustion and failure by avoiding erratic bumps against the casing 106 and whipstock 108 which may chip the exposed PDC inserts 212. As such, preserving the exposed PDC inserts 212 allows the exposed PDC inserts 212 to be used to cut the lateral wellbore 302 in the formation 105. A portion of the casing 106 ahead of the leading edge 224 of the milling blades 202 may remain uncut when the drilling blades 208 begin cutting the formation 105. As such, the carbide inserts 214 at or near the leading edge 224 may cut the casing 106 ahead of its path along the tapered portion of the whipstock 108. Therefore, it is possible that the milling blades 202 continue cutting the casing 106 even after the drilling blades 208 transition from cutting the casing 106 to cutting the formation 105.

FIG. 3D shows the tool 100 in the lateral wellbore 302 and the drill string 102 extending through the window 300. As shown, the milling blades 202 and the drilling blades 208 have completed creating the window 300. The window 300 may be sufficiently large to accommodate the tool 100, the drill string 102, and any other tools sent downhole. As shown, the formation 105 is being cut by the drilling blades 208 and the milling blades 202. For example, the exposed PDC inserts 212 may lead in cutting the lateral wellbore 302 and thereby remove the majority of the formation 105 ahead of the milling blades 202. The carbide inserts 214 may contribute in cutting the formation 105 by enlarging a diameter of the lateral wellbore 302 behind the drilling blades 208. For example, the carbide inserts 214 at or near the leading edge 224 may enlarge the diameter of the lateral wellbore 302 to approximate the diameter of the milling portion 110. During the course of the operation, the diameter of the milling portion 110 may deform and decrease in size. As such, the diameter of the lateral wellbore 302 may be equal to or less than the diameter of the milling portion 110 of the tool 100 at the beginning of the operation.

As will be understood by those skilled in the art, a number of variations and combinations may be made in relation to the disclosed embodiments all without departing from the scope of the invention.

In one embodiment, a method of cutting a casing and a formation includes providing a rotatable cutting tool in a wellbore, wherein the rotatable cutting tool includes a first portion configured for cutting the casing and a second portion configured for cutting the formation; engaging the first portion with the casing in the wellbore; and engaging the second portion with the casing after engaging the first portion with the casing.

In one embodiment, a method of cutting a casing and a formation includes providing a rotatable cutting tool in a wellbore, wherein the rotatable cutting tool includes a first portion configured for cutting the casing and a second portion configured for cutting the formation; engaging the first portion with the casing in the wellbore; and engaging the second portion with the casing after the first portion experiences uninterrupted cutting.

In one or more of the embodiments described herein, engaging the second portion with the casing occurs after the first portion experiences uninterrupted cutting.

In one or more of the embodiments described herein, uninterrupted cutting includes engaging at least one blade disposed on the first portion with the casing at any given time.

In one or more of the embodiments described herein, uninterrupted cutting occurs before forming a perforation in the casing using the first portion.

In one or more of the embodiments described herein, uninterrupted cutting occurs after forming a perforation in the casing using the first portion.

In one or more of the embodiments described herein, the first portion engages the casing using a durable material suitable for cutting the casing.

In one or more of the embodiments described herein, the durable material suitable for cutting the casing includes carbide.

In one or more of the embodiments described herein, the second portion engages the casing using a hard material suitable for cutting the formation.

In one or more of the embodiments described herein, the second portion engages the casing using an exposed hard material suitable for cutting the formation.

In one or more of the embodiments described herein, the exposed hard material suitable for cutting the formation includes polycrystalline diamond compact (PDC).

In one or more of the embodiments described herein, the second portion engages with the casing while the first portion remains engaged with the casing.

In one or more of the embodiments described herein, the second portion remains engaged with the casing while the first portion remains engaged with the casing.

In one or more of the embodiments described herein, the method also includes cutting the formation using the second portion.

In one or more of the embodiments described herein, the first portion engages the casing at a first contact point on an inner surface of the casing, the second portion engages the casing at a second contact point on the inner surface of the casing, and the second contact point is below the first contact point on the inner surface of the casing.

In one or more of the embodiments described herein, the first portion engages the casing at a first contact point on an inner surface of the casing.

In one or more of the embodiments described herein, the second portion engages the casing at a second contact point on the inner surface of the casing.

In one or more of the embodiments described herein, the second contact point is below the first contact point.

In one or more of the embodiments described herein, the first portion is configured to also cut the formation, and the second portion is configured to also cut the casing.

In one or more of the embodiments described herein, the rotatable cutting tool is not removed from the casing between the engaging the first portion with the casing and the engaging the second portion with the casing.

In one or more of the embodiments described herein, the method also includes setting a whipstock into the casing with the rotatable cutting tool, wherein the rotatable cutting tool is not removed from the casing between the setting the whipstock into the casing and at least one of the engaging the first portion with the casing and the engaging the second portion with the casing.

In another embodiment, a tool used for cutting a casing and cutting a formation includes a first portion having a first diameter and a durable material configured to cut the casing; a second portion, forward of the first portion, and having a second diameter and a hard material configured to cut the formation, wherein the first diameter is larger than the second diameter.

In another embodiment, a tool used for cutting a casing and cutting a formation includes a first portion having a first diameter and a durable material configured to cut the casing; a second portion, forward of the first portion, and having a second diameter and a hard material configured to cut the formation, wherein the first diameter is larger than the second diameter.

In one or more of the embodiments described herein, the tool also includes an axial clearance between the first portion and the second portion such that, during operation, the first portion engages the casing before the second portion engages the casing.

In another embodiment, a tool used for cutting a casing and cutting a formation includes a first portion having a durable material configured to cut the casing; a second portion having an exposed hard material configured to cut the formation; and an axial clearance between the first portion and the second portion such that the first portion engages the casing before the second portion engages the casing.

In one or more of the embodiments described herein, the durable material includes a crushed carbide in a braze matrix.

In one or more of the embodiments described herein, the durable material includes carbide.

In one or more of the embodiments described herein, the hard material includes PDC.

In one or more of the embodiments described herein, the exposed hard material includes polycrystalline diamond compact (PDC).

In one or more of the embodiments described herein, the durable material includes carbide and the hard material includes PDC.

In one or more of the embodiments described herein, the durable material includes carbide and the exposed hard material includes PDC.

In one or more of the embodiments described herein, the first portion includes a first plurality of blades disposed on an outer diameter of the tool.

In one or more of the embodiments described herein, the first portion includes a plurality of blades disposed on an outer diameter of the tool.

In one or more of the embodiments described herein, the durable material is disposed on the first plurality of blades.

In one or more of the embodiments described herein, the durable material is disposed on the plurality of blades.

In one or more of the embodiments described herein, the second portion includes a second plurality of blades disposed towards an end of the tool.

In one or more of the embodiments described herein, the second portion includes a plurality of blades disposed towards an end of the tool.

In one or more of the embodiments described herein, the exposed hard material is disposed on the second plurality of blades.

In one or more of the embodiments described herein, the exposed hard material is disposed on the plurality of blades.

In one or more of the embodiments described herein, the first portion includes a first plurality of blades disposed on an outer diameter of the tool, the second portion includes a second plurality of blades disposed towards an end of the tool, and a sweep of the first plurality of blades is larger than a sweep of the second plurality of blades.

In one or more of the embodiments described herein, a sweep of the plurality of blades of the first portion is larger than a sweep of the plurality of blades on the second portion.

In one or more of the embodiments described herein, using the tool for cutting a casing and cutting a formation includes cutting the casing with the first portion of the tool; and cutting the formation with the second portion of the tool, wherein the tool is not removed from the casing between the cutting the casing and the cutting the formation.

In one or more of the embodiments described herein, using the tool for cutting a casing and cutting a formation includes setting a whipstock into the casing with the tool; cutting the casing with the first portion of the tool; and cutting the formation with the second portion of the tool, wherein the tool is not removed from the casing between the setting the whipstock and at least one of the cutting the casing and the cutting the formation.

In another embodiment, an assembly for cutting a casing and a formation includes a whipstock disposable in the casing; and a tool having a first cutting portion, a second cutting portion, forward of the first cutting portion, with a hard material, and an axial clearance therebetween to allow the first cutting portion to engage the whipstock while the hard material does not engage either the whipstock or the casing.

In another embodiment, an assembly for cutting a casing and a formation includes a whipstock disposable in the casing; and a tool having a first cutting portion, a second cutting portion with an exposed hard material, and an axial clearance therebetween such that the first cutting portion engages the casing before the second cutting portion engages the casing.

In one or more of the embodiments described herein, the whipstock is configured to move the first cutting portion such that the first cutting portion forms a perforation in the casing.

In one or more of the embodiments described herein, the tool is configured to rotate in the casing, and the whipstock is configured to move the first cutting portion such that, throughout a rotation of tool, at least one blade disposed on the first cutting portion contacts the casing at all times.

In one or more of the embodiments described herein, the whipstock is configured to move the first cutting portion such that at least one blade disposed on the first cutting portion contacts the casing at any given time.

In one or more of the embodiments described herein, the first cutting portion includes a durable material suitable for cutting the casing.

In one or more of the embodiments described herein, the second cutting portion includes an exposed hard material suitable for cutting the formation.

In one or more of the embodiments described herein, the durable material includes carbide.

In one or more of the embodiments described herein, the exposed hard material includes PDC.

In one or more of the embodiments described herein, the first cutting portion includes carbide and the second cutting portion includes exposed PDC.

In another embodiment, a method of assembling a tool for cutting a casing and a formation includes providing the tool with a first cutting portion, a second cutting portion, and an axial clearance between the first cutting portion and the second cutting portion; providing a durable cutting material on the first cutting portion, the durable cutting material configured to cut the casing; providing an exposed hard cutting material on the second cutting portion, the exposed hard cutting material configured to cut the formation; and configuring the axial clearance such that, during operation, the durable cutting material engages the casing before the exposed hard cutting material engages the casing.

In another embodiment, a method of cutting a casing and a formation includes providing a tool with a first cutting portion, a second cutting portion, and an axial clearance between the first cutting portion and the second cutting portion; providing a durable cutting material on the first cutting portion, the durable cutting material configured to cut the casing; providing an exposed hard cutting material on the second cutting portion, the exposed hard cutting material configured to cut the formation; and configuring the axial clearance such that the durable cutting material engages the casing before the exposed hard cutting material engages the casing.

In one or more of the embodiments described herein, the method also includes providing a whipstock operatively coupled to the tool.

In one or more of the embodiments described herein, the durable cutting material includes at least one carbide material selected from the group consisting of exposed carbide, tungsten carbide, carbide inserts, and crushed carbide.

In one or more of the embodiments described herein, the method also includes brazing the carbide material onto the first cutting portion.

In one or more of the embodiments described herein, the brazing utilizes a copper nickel alloy.

In one or more of the embodiments described herein, the exposed hard cutting material includes exposed PDC inserts.

In one or more of the embodiments described herein, the method also includes brazing the exposed PDC inserts onto the second cutting portion.

In one or more of the embodiments described herein, the brazing utilizes a copper nickel alloy.

The invention claimed is:

1. A method of cutting a casing and a formation, comprising:

providing a rotatable cutting tool in a casing disposed in a wellbore, wherein the rotatable cutting tool includes a first portion having a first plurality of blades configured for cutting the casing and a second portion having a second plurality of blades configured for cutting the formation;

engaging the first plurality of blades with a whipstock and an initial engagement point of the casing, wherein the second plurality of blades does not contact the whipstock or the casing; and engaging the second plurality of blades with the casing after engaging the first plurality of blades with the casing, wherein engaging the second plurality of blades with the casing occurs after the first plurality of blades experiences uninterrupted cutting, wherein uninterrupted cutting includes at least one of the first plurality of blades of the first portion engages the casing throughout each rotation of the rotatable cutting tool.

2. The method of claim 1, wherein the rotatable cutting tool includes an axial clearance between the first plurality of blades and the second plurality of blades.

3. The method of claim 1, wherein the second plurality of blades does not engage the whipstock while the first plurality of blades experiences uninterrupted cutting.

4. The method of claim 1, wherein the second plurality of blades do not engage the casing until the first plurality of blades forms a perforation in the casing.

5. The method of claim 1, wherein uninterrupted cutting occurs before forming a perforation in the casing using the first portion.

6. The method of claim 1, wherein the uninterrupted cutting occurs after forming a perforation in the casing using the first portion.

7. The method of claim 1, wherein the first portion engages the casing using a durable material suitable for cutting the casing.

8. The method of claim 7, wherein the durable material suitable for cutting the casing includes carbide.

9. The method of claim 1, wherein the second portion engages the casing using a hard material suitable for cutting the formation.

10. The method of claim 9, wherein the hard material suitable for cutting the formation includes polycrystalline diamond compact (PDC).

11. The method of claim 1, wherein the second portion engages with the casing while the first portion remains engaged with the casing.

12. The method of claim 1, further comprising cutting the formation using the second portion.

13. The method of claim 1, wherein the second portion engages the casing at a second contact point on an inner surface of the casing, and the second contact point is below the initial engagement point.

14. The method of claim 1, wherein the first portion is configured to also cut the formation, and the second portion is configured to also cut the casing.

15. The method of claim 1, wherein the rotatable cutting tool is not removed from the casing between the engaging the first portion with the casing and the engaging of the second portion with the casing.

16. The method of claim 1, further comprising setting the whipstock into the casing with the rotatable cutting tool, wherein the rotatable cutting tool is not removed from the casing between the setting of the whipstock into the casing and at least one of the engaging of the first portion with the casing and the engaging of the second portion with the casing.

17. A tool used for cutting a casing and cutting a formation, comprising:

a first portion having a first plurality of blades having a first diameter and a durable material configured to cut the casing;

a second portion, forward of the first portion, and having a second plurality of blades having a second diameter and a hard material configured to cut the formation, wherein the first diameter is larger than the second diameter; and an axial clearance between an end of the first plurality of blades and an end of the second plurality of blades such that:

in an initial position of the first portion and the second portion, the first plurality of blades engage a whipstock and an initial contact point of the casing, wherein the second plurality of blades do not engage the casing or the whipstock; and the second plurality of blades engages the casing after the first plurality of blades experiences uninterrupted cutting of the casing.

18. The tool of claim 17, wherein:

the durable material includes carbide; and the hard material includes polycrystalline diamond compact.

19. The tool of claim 17, wherein:

the first portion is configured to form a perforation in the casing; and the second portion is configured to engage the casing after the perforation is formed.

20. The tool of claim 17, wherein:

the first portion includes the first plurality of blades disposed on an outer diameter of the tool; and uninterrupted cutting includes at least one of the first plurality of blades engaging the casing throughout each rotation of the tool.

21. The tool of claim 20, wherein the durable material is disposed on the first plurality of blades.

22. The tool of claim 17, wherein the second plurality of blades is disposed towards an end of the tool.

23. The tool of claim 22, wherein the hard material is disposed on the second plurality of blades.

24. The tool of claim 17, wherein the first portion includes the first plurality of blades disposed on an outer diameter of the tool;

the second portion includes the second plurality of blades disposed towards an end of the tool; and a sweep of the first plurality of blades is larger than a sweep of the second plurality of blades.

* * * * *